US006868681B2

(12) United States Patent
Woo et al.

(10) Patent No.: US 6,868,681 B2
(45) Date of Patent: Mar. 22, 2005

(54) AIR CONDITIONER

(75) Inventors: Hyung Joo Woo, Changwon-si (KR); Su Chang Woo, Changwon-si (KR); Kyung Sik Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/705,458

(22) Filed: Nov. 12, 2003

(65) Prior Publication Data

US 2004/0099006 A1 May 27, 2004

(30) Foreign Application Priority Data

Nov. 21, 2002 (KR) ..... 10-2002-0072883
Jan. 24, 2003 (KR) ..... 10-2003-0004896

(51) Int. Cl.[7] ..... F25B 7/00; F25B 5/00; F25B 43/02

(52) U.S. Cl. ..... 62/175; 62/199; 62/470; 62/510

(58) Field of Search ..... 62/175, 192, 199, 62/200, 470, 471, 570

(56) References Cited

U.S. PATENT DOCUMENTS 4,389,855 A * 6/1983 Ueda et al. ..... 62/200
5,333,678 A * 8/1994 Mellum et al. ..... 165/42
5,369,958 A * 12/1994 Kasai et al. ..... 62/158
6,205,802 B1 * 3/2001 Drucker et al. ..... 62/236
6,698,217 B2 * 3/2004 Tanimoto et al. ..... 62/175
6,735,965 B2 * 5/2004 Moon et al. ..... 62/175

* cited by examiner

*Primary Examiner*—Marc Norman
(74) *Attorney, Agent, or Firm*—Birch, Stewart, Kolasch & Birch, LLP

(57) ABSTRACT

Disclosed herein is an air conditioner comprising a plurality of indoor units and a common outdoor unit connected to each of the indoor units. The air conditioner further includes an additional indoor unit connected to an air conditioner comprising an indoor unit and an outdoor unit connected to the indoor unit. The additional indoor unit is installed in some place other than the installation place of the indoor unit. The indoor units are selectively or simultaneously operated by means of effective distribution of coolant in the outdoor unit so that the indoor units are properly operated by means of the single outdoor unit to provide a pleasant air conditioned environment.

22 Claims, 8 Drawing Sheets

AIR CONDITIONER

This Nonprovisional application claims priority under 35 U.S.C. § 119(a) on Patent Application No(s). 10-2002-0072883 and 10-2003-0004896 filed in KOREA on Nov. 21, 2002 and Jan. 24, 2003, the entire contents of which are hereby incorporated by reference.

BACKGROUND OF THE INVENTION

1. Field of the Invention

The present invention relates to an air conditioner comprising a plurality of indoor units and a common outdoor unit connected to each of the indoor units, and more particularly to an improved air conditioner further including an additional indoor unit connected to an air conditioner comprising an indoor unit and an outdoor unit connected to the indoor unit, wherein a plurality of the indoor units can be simultaneously or individually operated by means of effective distribution of coolant in the outdoor unit of the air conditioner.

2. Description of the Related Art

As well known to those skilled in the art, air conditioners are generally classified into a separated type air conditioner comprising an indoor unit and an outdoor unit, which are separated from each other; an integrated type air conditioner comprising an indoor unit and an outdoor unit, which are integrated with each other; a wall mounted type air conditioner and a picture frame type air conditioner, each of which is mounted to a wall of a house; a free-standing type air conditioner which is constructed to stand in a room of a house; a single-split type air conditioner having a capacity to operate a single indoor unit in a small area such as a dwelling house; a medium- or large-sized type air conditioner having a large capacity to operate an indoor unit in a medium or large area such as an office building or a restaurant; and a multi-split type having a sufficient capacity to operate a plurality of indoor units.

The separated type air conditioner comprises an indoor unit disposed or mounted in a room of a house for supplying warm air or cool air to a room where the air conditioning is needed, and an outdoor unit for compressing and expanding a coolant so that a sufficient heat exchange operation is carried out in the indoor unit.

The multi-split type air conditioner comprises a plurality of indoor units disposed or mounted in a plurality of divided areas in a building, such as a school building, for individually supplying warm air or cool air to a space where the air conditioning is needed in each of the areas, and one or more outdoor units. The indoor and outdoor units constitute together a plurality of cooling cycles. In the aforesaid multi-split type air conditioner, however, the outdoor units must have sufficient capacities to simultaneously operate all of the indoor units even when all of the indoor units are operated at their maximum outputs. In other words, when a plurality of the indoor units are operated at their maximum outputs, the outdoor units of the multi-split type air conditioner must have capacities proportional to such outputs of the indoor units.

The single-split type air conditioner generally comprises an indoor unit and an outdoor unit. The indoor and outdoor units together constitute a cooling cycle. The capacity of the indoor unit is proportional to that of the outdoor unit. In other words, the outdoor unit of the single-split type air conditioner has a sufficient capacity to operate the indoor unit at its maximum output.

Among the aforesaid various kinds of the air conditioner, the present invention is connected with the separated single-split type air conditioner.

In Korea, most homes are generally organized by units of a family, and a life pattern in each of the homes is generalized. Most of the air conditioners are usually operated in the afternoon, and at that time the members of the family spend their time together in a living room or the other rooms of a house.

The air conditioner used in such a home is the single-split type air conditioner. As described above, the single-split type air conditioner comprises an indoor unit and an outdoor unit connected to the indoor unit. The outdoor unit of the single-split type air conditioner has a sufficient capacity to operate the indoor unit at its maximum output.

A conventional single-split type air conditioner is shown in FIGS. 1 and 2. As shown in FIGS. 1 and 2, the single-split type air conditioner comprises an outdoor unit 10 and an indoor unit 20. The indoor unit 20 is installed in a living room or in one of the other rooms of the house.

The indoor unit of the single-split type air conditioner cannot be moved from one place to another place in the house. Consequently, the indoor unit of the air conditioner must be installed only in the living room or in one of the other rooms of the house, by which the air conditioning is accomplished only in the living room where the indoor unit of the air conditioner is installed or in one of the other rooms of the house where the indoor unit of the air conditioner is installed.

When the single-split type air conditioner has a capacity to air condition only the living room where the indoor unit of the air conditioner is installed or only one of the other rooms of the house where the indoor unit of the air conditioner is installed, the member(s) of the family in the other rooms of the house where the indoor unit of the air conditioner is not installed cannot enjoy the benefits of the air conditioning. However, it is possible for the member(s) of the family in the other rooms of the house where the indoor unit of the air conditioner is not installed to enjoy the benefits of the air conditioning if the air conditioner has a large enough capacity to air condition all of the rooms of the house, including the living room. To this end, an air conditioner having such a large capacity must be bought, which incurs an economic burden.

The aforesaid single-split type air conditioner having only a single indoor unit does not harmonize with the life patterns of most of the homes in Korea. As a result, a degree of satisfaction with the air conditioner is lowered, and thus a competitive power of the air conditioner is reduced.

SUMMARY OF THE INVENTION

Therefore, the present invention has been made in view of the above problems, and it is an object of the present invention to provide an improved air conditioner further including an additional indoor unit connected to an air conditioner comprising an indoor unit and an outdoor unit connected to the indoor unit, wherein pressure reduction and flow rate of a coolant in the indoor units are effectively controllable by the outdoor unit, whereby the air conditioning is effectively accomplished.

In accordance with one aspect of the present invention, the above and other objects can be accomplished by the provision of an air conditioner comprising: an outdoor unit including a plurality of compressors for compressing a coolant, an outdoor heat exchanger connected to each of the compressors for condensing or evaporating the coolant as a condenser or an evaporator during cooling or heating a room of a house, and an expander connected to the outdoor heat exchanger for expanding the coolant; and an indoor unit including an indoor heat exchanger connected to the outdoor unit for evaporating or condensing the coolant as an evaporator or a condenser during cooling or heating the room of the house, the outdoor and indoor units together constituting a cooling cycle, wherein the outdoor unit comprises: a plurality of discharging pipes connected to the compressors for discharging the coolants compressed in the compressors, respectively; a connection pipe for gathering the coolants leaving the discharging pipes to guide the gathered coolants via the condenser, the expander, and the evaporator; a plurality of introducing pipes each branched off the end of the connection pipe for introducing the coolants into the compressors, respectively; and an oil separator disposed between the connection pipe and the introducing pipes for separating oil from the coolants discharged from the compressors, and wherein the air conditioner further comprises at least one auxiliary indoor unit including an indoor heat exchanger detachably attached to the outdoor unit.

In accordance with another aspect of the present invention, there is provided an air conditioner comprising: an outdoor unit including a plurality of compressors for compressing a coolant, an outdoor heat exchanger connected to each of the compressors for condensing or evaporating the coolant as a condenser or an evaporator during cooling or heating a room of a house, and an expander connected to the outdoor heat exchanger for expanding the coolant; and an indoor unit including an indoor heat exchanger connected to the outdoor unit for evaporating or condensing the coolant as an evaporator or a condenser during cooling or heating the room of the house, the outdoor and indoor units constituting together a cooling cycle, wherein the outdoor unit comprises: a plurality of discharging pipes connected to the compressors for discharging the coolants compressed in the compressors, respectively; a connection pipe for gathering the coolants leaving the discharging pipes to guide the gathered coolants via the condenser, the expander, and the evaporator; a plurality of introducing pipes each branched off the end of the connection pipe for introducing the coolants into the compressors, respectively; and an oil separator disposed between the connection pipe and the introducing pipes for separating oil from the coolants discharged from the compressors, and wherein the air conditioner further comprises: at least one auxiliary indoor unit including an indoor heat exchanger detachably attached to the outdoor unit; and an expansion distributor disposed between the outdoor unit and the indoor unit and between the outdoor unit and the auxiliary indoor unit for expanding the coolants to distribute the expanded coolants into each of the indoor heat exchangers of the indoor unit and the auxiliary indoor unit.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
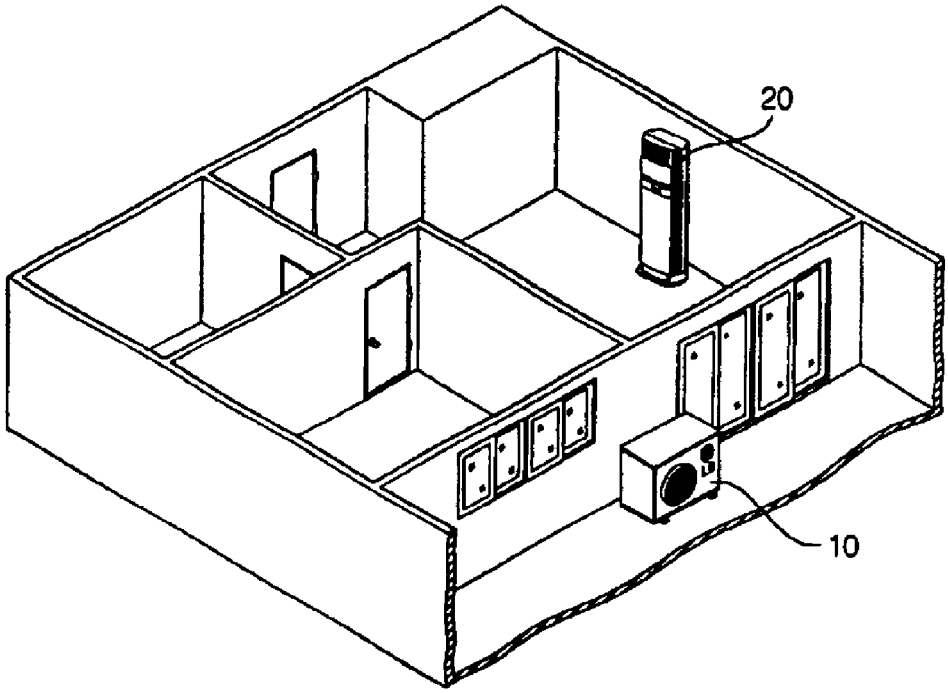
FIG. 1(Prior Art)
FIG. 1 is a view of a conventional air conditioner showing installation of the air conditioner in a house.
Figure 2:
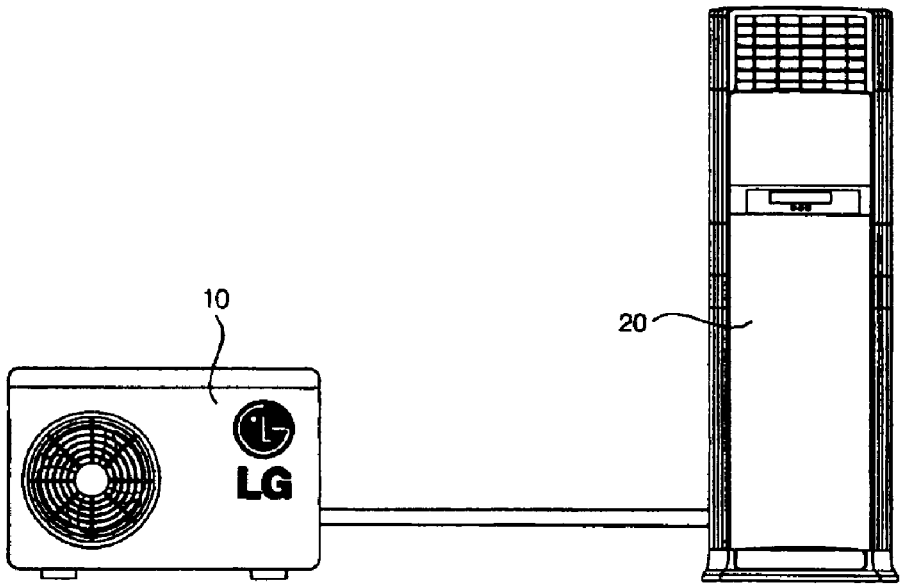
FIG. 2(Prior Art)
FIG. 2 is a view of the conventional air conditioner showing connection of an indoor unit of the air conditioner to an outdoor unit of the air conditioner.
Figure 3:
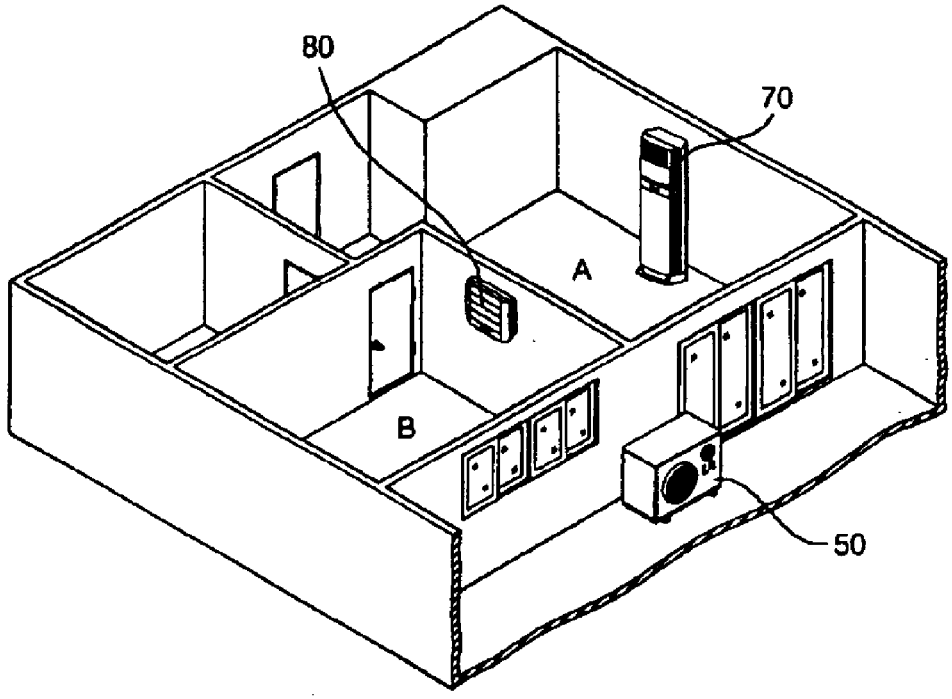
FIG. 3 is a view of an air conditioner according to the present invention showing installation of the air conditioner in a house.
Figure 4:
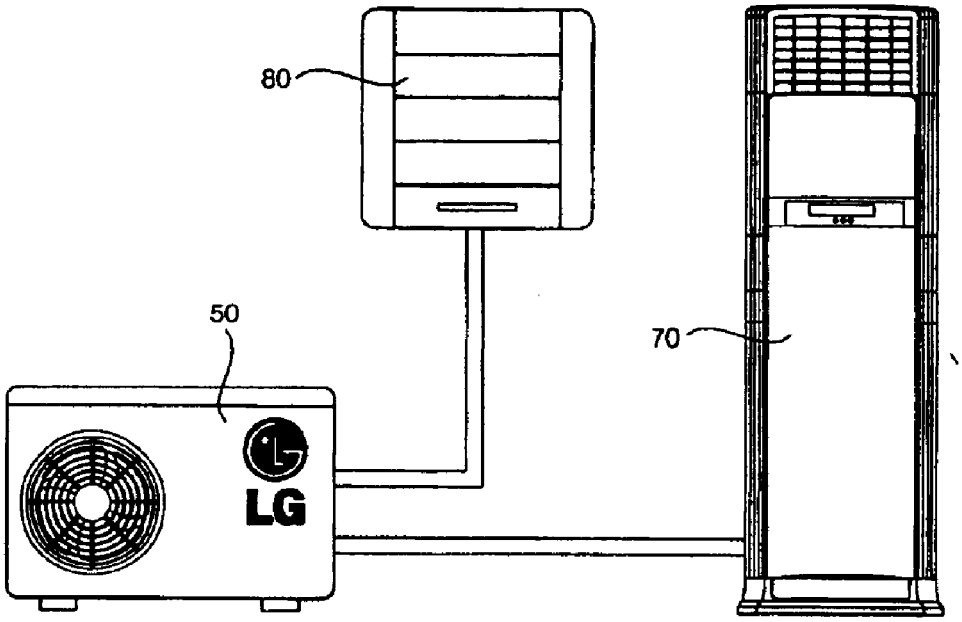
FIG. 4 is a view of the air conditioner according to the present invention showing connection of indoor units of the air conditioner to an outdoor unit of the air conditioner.

FIG. 3 is a view of an air conditioner according to the present invention showing installation of the air conditioner in a house, and FIG. 4 is a view of the air conditioner according to the present invention showing connection of indoor units of the air conditioner to an outdoor unit of the air conditioner.

As shown in FIGS. 3 and 4, the air conditioner comprises an outdoor unit 50, a first indoor unit 70, and a second indoor unit 80. The outdoor unit 50 is connected to the first indoor units 70. The outdoor unit 50 is also connected to the second indoor unit 80. In the outdoor unit 50 is disposed an expansion distributor (See FIG. 5) for controlling pressure reduction and flow rate of a coolant supplied to each of the first and second indoor units 70 and 80. The expansion distributor is operated by means of a controlling unit, which will be described later in detail.

The aforesaid multi-split type air conditioner includes one or more outdoor units having sufficient capacities to simultaneously operate all of the indoor units even when all of the indoor units are operated at their maximum outputs. The outdoor and indoor units constitute together a plurality of cooling cycles. In the air conditioner according to the present invention, however, the outdoor unit 50 has a capacity to operate only one of the first and second indoor units 70 and 80 when it is operated at its maximum output although the outdoor unit 50 is connected to the first indoor unit 70 as well as the second indoor unit 80. The outdoor and indoor units together constitute a single cooling cycle. Consequently, the first and second indoor units 70 and 80 cannot be simultaneously operated at their maximum outputs. Otherwise, only one of the first and second indoor units 70 and 80 can be operated at its maximum output, or both of the first and second indoor units 70 and 80 can be simultaneously operated at their appropriate outputs.

The air conditioner according to the present invention further includes an additional indoor unit connected to an air conditioner comprising an indoor unit and an outdoor unit connected to the indoor unit.

The air conditioner with the above-stated construction according to the present invention may be usually used for a house. The first and second indoor units 70 and 80 are installed in a first air-conditioning space A and a second air-conditioning space B, respectively. The first and second indoor units 70 and 80 can be selectively or simultaneously operated to cool or warm the desired air-conditioning space (s).

The first and second indoor units 70 and 80 may include a living room or one of the other rooms of the house.

Figure 5:
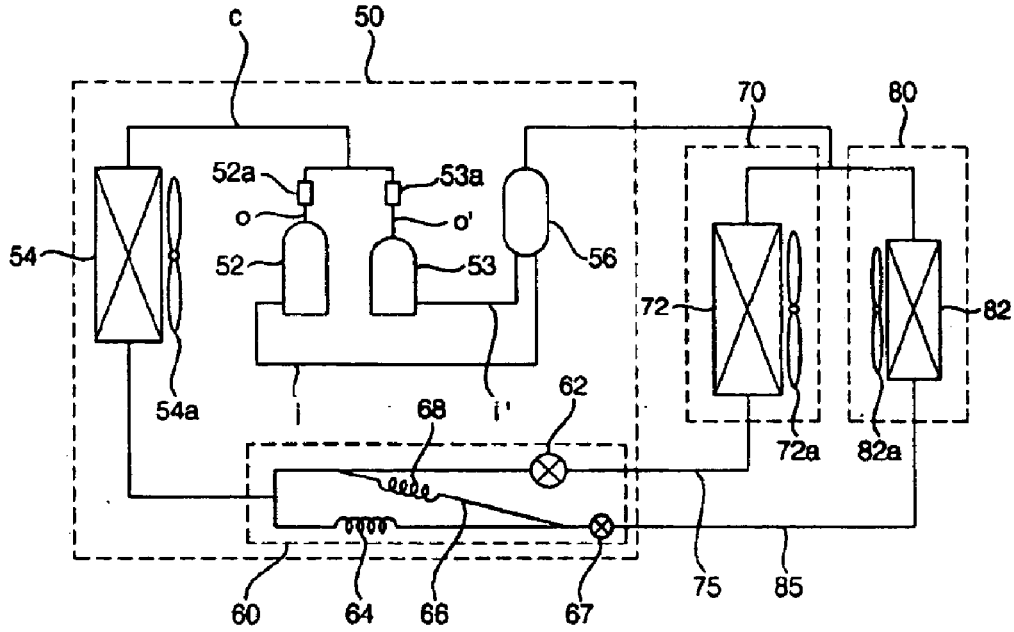
FIG. 5 is a schematic circuit diagram of an air conditioner according to a first preferred embodiment of the present invention.
Figure 6:
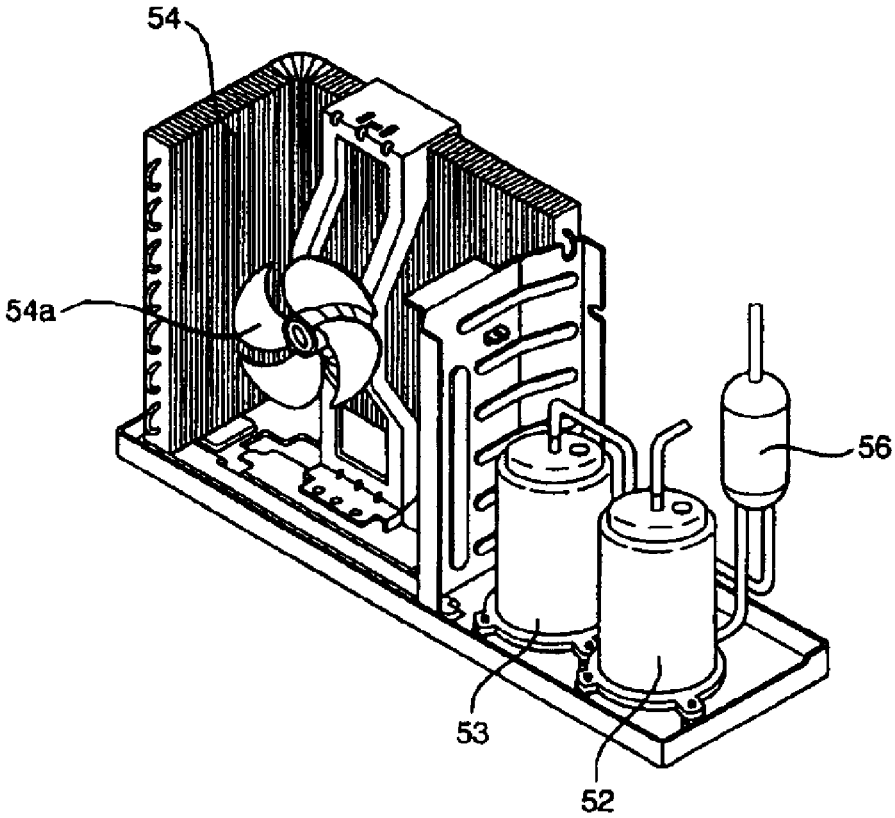
FIG. 6 is a perspective view of an outdoor unit of the air conditioner according to the present invention with its upper case removed.
Figure 7:
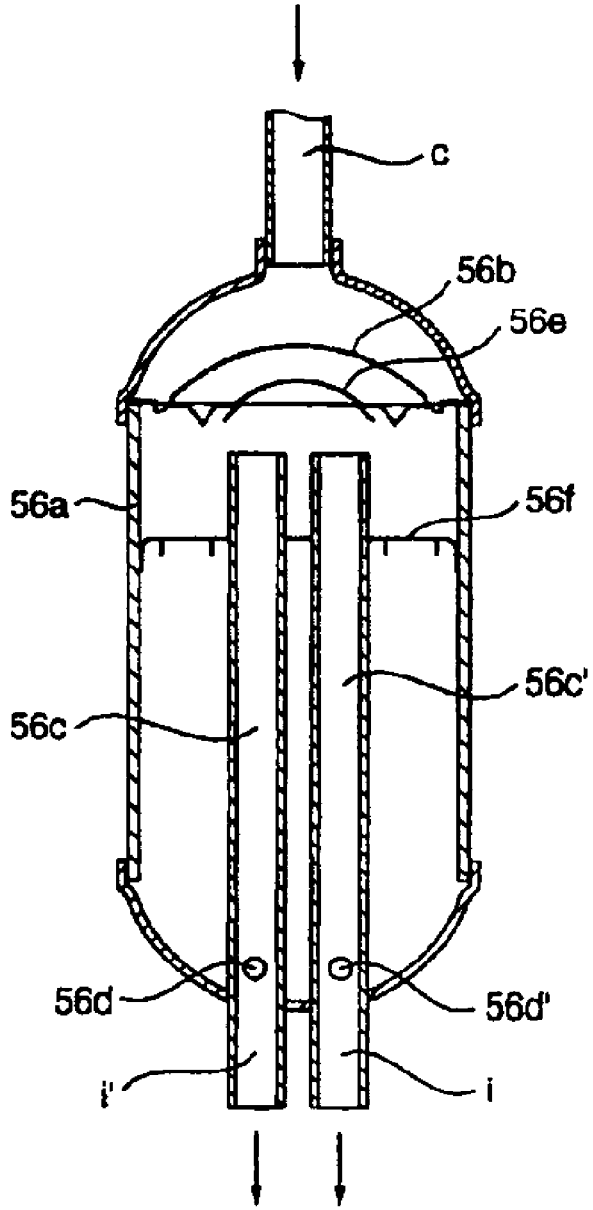
FIG. 7 is a longitudinal sectional view of an oil separator of the air conditioner according to the present invention.

FIG. 5 is a schematic circuit diagram of an air conditioner according to a first preferred embodiment of the present invention, FIG. 6 is a perspective view of an outdoor unit of the air conditioner according to the present invention with its upper case removed, and FIG. 7 is a longitudinal sectional view of an oil separator of the air conditioner according to the present invention.

As best shown in FIG. 5, one of the indoor units 70 (hereinafter, referred to as the first indoor unit) is connected to the outdoor unit 50 having a capacity to operate the first indoor unit 70 at its maximum output, to which the other of the indoor units 80 (hereinafter, referred to as the first indoor unit) is also connected. That is to say, the air conditioner shown in FIG. 5 comprises the outdoor unit 50 mounted outside the room for compressing, condensing, and decompressing the coolant, and the first and second indoor units 70 and 80 each connected to the outdoor unit 50 and individually mounted in the rooms for evaporating the coolant.

As shown in FIG. 6, the outdoor unit 50 comprises: a plurality of compressors 52 and 53 for compressing the coolant to obtain gaseous coolant having high temperature and high pressure; an outdoor heat exchanger 54 connected to the compressors 52 and 53 for condensing the coolant by heat exchange between the coolant and outdoor air to obtain liquefied coolant having intermediate pressure and high temperature; and an outdoor fan 54*a* mounted at the outdoor heat exchanger 54 for blowing the outdoor air to the outdoor heat exchanger 54.

The aforesaid compressors comprise a first compressor 52 having a coolant compression capacity of X %, and a second compressor 53 having a coolant compression capacity of (100−X) %. The coolant compression capacity of the first compressor 52 is larger than that of the second compressor 53.

The outdoor unit 50 of the air conditioner further comprises an expansion distributor 60 disposed between the outdoor unit 50 and the first indoor unit 70 and between the outdoor unit 50 and the second indoor unit 80 in such a manner that supply of the coolant to the first and second indoor units 70 and 80 is controlled. The expansion distributor 60 controls a degree of decompression of the coolant and flow rate of the circulating coolant.

Especially, the outdoor unit 50 further comprises: discharging pipes o and o' connected to the first and second compressors 52 and 53 for discharging the coolants compressed in the first and second compressors 52 and 53, respectively; check valves 52*a* and 53*a* in the discharging pipes o and o' at the rear end of the first and second compressors 52 and 53 for preventing the coolant having passed through the first and second compressors 52 and 53 from flowing backward; a connection pipe c for gathering the coolants leaving the discharging pipes o and o' to guide the gathered coolants via the condenser, the expander, and the evaporator in the cooling cycle; introducing pipes i and i' each branched off the end of the connection pipe c for introducing the coolants into the first and second compressors 52 and 53, respectively; and an oil separator 56 disposed between the connection pipe c and the introducing pipe i and between the connection pipe c and the introducing pipe i's for separating oil from the coolants discharged from the first and second compressors 52 and 53.

Of course, the outdoor unit 50 of the air conditioner may further comprise a pair of accumulators (not shown) for accumulating surplus coolant produced depending upon the operating capacities of the first and second compressors 52 and 53 from the coolant having passed through the oil separator 56 and for separating the liquefied coolant from the coolant flowing into the first and second compressors 52 and 53.

Nevertheless, it should be noted that the oil separator 56 may be adapted to serve as the aforesaid accumulators, i.e., to separate the liquefied coolant from the coolant flowing into the compressors 52 and 53 so that the operational reliability of each of the compressors 52 and 53 can be ensured as well as to separate the oil from the coolant so that it is supplied again to the first and second compressors 52 and 53.

As shown in FIG. 7, the oil separator 56 comprises: a hermetically sealed casing 56*a* connected between the introducing pipes i and i' where the coolant is mixed together before the coolant is supplied to the first and second compressors 52 and 53; a screen mesh 56*b* mounted in the inner upper part of the casing 56*a* for filtering foreign matters from the coolant and the oil; and oil separating pipes 56*c* and 56*c*' disposed below the screen mesh 56*b*. One of the oil separating pipes 56*c* has one end placed above the height of the liquefied coolant so that only gaseous coolant is introduced into casing 56*a*. The other end of the oil separating pipe 56*c* is connected to one of the introducing pipes i' for introducing the coolant into one of the first and second compressors 52 and 53. Similarly, the other of the oil separating pipes 56*c*' has one end placed above the height of the liquefied coolant so that only gaseous coolant is introduced into casing 56*a*. The other end of the oil separating pipe 56*c*' is connected to the other of the introducing pipes i for introducing the coolant into the other of the first and second compressors 52 and 53. At the lower parts of the oil separating pipes 56 and 56' are formed oil collection holes 56*d* and 56*d*' through which the oil gathered on the bottom of the casing 56*a* is introduced into the oil separating pipes 56*c* and 56*c*' by the force of a flow of the gaseous coolant, respectively.

Preferably, the oil separator 56 further comprises a disc-shaped screen 56*e* interposed between the screen mesh 56*b* and the upper end of each of the oil separating pipes 56*c* and 56*c*' for preventing the liquefied coolant from flowing into the upper end of each of the oil separating pipes 56*c* and 56*c*'; and a fixing bracket 56*f* for fixing the oil separating pipes 56*c* and 56*c*' to the inner wall of the casing 56*a* to prevent the oil separating pipes 56*c* and 56*c*' from shaking in the casing 56*a*.

The first indoor unit 70 comprises a first indoor heat exchanger 72 connected to the expansion distributor 60 via a coolant pipe 75 for producing cool air by heat exchange between the coolant and indoor air and evaporating the coolant to obtain gaseous coolant having low temperature and low pressure; and a first indoor fan 72*a* disposed at the first indoor heat exchanger 72 for blowing the indoor air to the first indoor heat exchanger 72. Similarly, the second indoor unit 80 comprises a second indoor heat exchanger 82 connected to the expansion distributor 60 via a coolant pipe 85 for producing cool air by heat exchange between the coolant and indoor air and evaporating the coolant to obtain gaseous coolant having low temperature and low pressure; and a first indoor fan 82*a* disposed at the second indoor heat exchanger 82 for blowing the indoor air to the second indoor heat exchanger 82.

It is preferable that the heat exchange capacity of the first indoor heat exchanger 72 of the first indoor unit 70 is larger than that of the second indoor heat exchanger 82 of the second indoor unit 80 so that the first indoor unit 70 can handle a larger cooling load than the second indoor unit 80.

Operation of the air conditioner constructed as mentioned above is controlled by a microcomputer (not shown), and the first and second compressors 52 and 53 are operated on the basis of the operations of the first and second indoor units 70 and 80, respectively.

When only the first indoor unit 70 is operated, at least one of the first and second compressors 52 and 53 is operated depending upon the cooling load. When only the second indoor unit 80 is operated, the first compressor 52 is not operated, but the second compressor 53 is operated. When both of the first indoor units 70 and 80 are operated simultaneously, both of the first and second compressors 52 and 53 are operated.

The expansion distributor 60 comprises: an electronic expansion valve 62 disposed between the outdoor heat exchanger 54 and the first indoor heat exchanger 72 for controlling the flow rate of the coolant and decompressing the coolant; a capillary tube 64 disposed between the outdoor heat exchanger 54 and the second indoor heat exchanger 82 for decompressing the coolant; and a distributing unit disposed between the electronic expansion valve 62 and the capillary tube 64 for selectively distributing the coolant having passed through the electronic expansion valve 62 or the capillary tube 64 depending upon operations of the first and second indoor units 70 and 80.

The distributing unit comprises: a connection passage 66 connected between the front end of the electronic expansion valve 62 and the rear end of the capillary tube 64 in such a manner that the coolant flows between the electronic expansion valve 62 and the capillary tube 64; an auxiliary capillary tube 68 disposed in the connection passage 66 for decompressing the coolant; and a shutoff valve 67 mounted at the rear end of the capillary tube 64 for allowing or preventing the flow of the coolant having passed through the capillary tube 64 and the auxiliary capillary tube 68.

Preferably, the shutoff valve 67 is a solenoid valve that can be controlled by an electrical signal from the microcomputer.

TABLE 1

| Operating Indoor Unit | Electronic Expansion Valve 62 | Shutoff Valve 67 |
|---|---|---|
| First Indoor Unit 70 | On | Off |
| Second Indoor Unit 80 | Off | On |
| First and Second Indoor Units 70 and 80 | On | On |

When only the first indoor unit 70 is operated, the electronic expansion valve 62 of the expansion distributor 60 is opened, and the shutoff valve 67 of the expansion distributor 60 is closed, as indicated in Table 1, so that the coolant passes through the electronic expansion valve 62 and then is introduced into the first indoor heat exchanger 72.

When only the second indoor unit 80 is operated, the electronic expansion valve 62 of the expansion distributor 60 is closed, and the shutoff valve 67 of the expansion distributor 60 is opened, as indicated in Table 1, so that the coolant passes through the capillary tube 64 and the auxiliary capillary tube 68 and then is introduced into the second indoor heat exchanger 82.

When both of the first and second indoor units 70 and 80 are simultaneously operated, the electronic expansion valve 62 and the shutoff valve 67 of the expansion distributor 60 are simultaneously opened, as indicated in Table 1, so that the coolant passes through the electronic expansion valve 62 and the capillary tube 64, and then is introduced into the first and second indoor heat exchangers 72 and 82, respectively.

The cooling operation of the air conditioner with the above-stated construction according to the first preferred embodiment of the present invention is as follows:

When only the first indoor unit 70 is operated by a user, at least one of the first and second compressors 52 and 53 is operated depending upon the cooling load thereof. The electronic expansion valve 62 is opened, and at the same time the shutoff valve 67 is closed. The outdoor fan 54*a* and the first indoor fan 72*a* are operated.

The coolant passes through the current operating one of the first and second compressors 52 and 53 with the result that gaseous coolant having high temperature and high pressure is obtained. The coolant having passed through the first compressor 52 or the second compressor 53 passes through the outdoor heat exchanger 54, where heat exchange is performed between the coolant and outdoor air blown by the outdoor fan 54*a* to obtain liquefied coolant having intermediate temperature and high pressure. The coolant having passed through the outdoor heat exchanger 54 passes through the electronic expansion valve 62 so that the coolant is decompressed to obtain coolant having low temperature and low pressure. The coolant having passed through the electronic expansion valve 62 passes through the first indoor heat exchanger 72, where heat exchange is performed between the coolant and indoor air blown by the first indoor fan 72*a* to obtain gaseous coolant having low temperature and low pressure, by which cool air is produced in the space where the first indoor unit 70 is installed. The coolant having passed through the first indoor heat exchanger 72 passes through the oil separator 56, by which oil is separated from the coolant, and the coolant containing no oil therein is introduced into the operating first compressor 52 or the operating second compressor 53.

As described above, the coolant is circulated through the first compressor 52 or the second compressor 53, the outdoor heat exchanger 54, the electronic expansion valve 62, the first indoor heat exchanger 72, and the oil separator 56, to cool the space where the first indoor unit 70 is installed.

The operation of the first compressor 52 and/or the second compressor 53 is determined depending upon the indoor load of the space where the first indoor unit 70 is installed and the outdoor load of the space where the outdoor unit 50 is installed. The first and second compressors 52 and 53 are simultaneously operated when the load is relatively high. One of the first and second compressors 52 and 53 is operated when the load is relatively low. The degree of opening of the electronic expansion valve 62 is also controlled on the basis of the load.

When only the second indoor unit 80 is operated by the user, at least one of the first and second compressors 52 and 53 is operated. The electronic expansion valve 62 is closed, and at the same time the shutoff valve 67 is opened. The outdoor fan 54*a* and the second indoor fan 82*a* are operated.

The coolant passes through the current operating one of the first and second compressors 52 and 53 with the result that gaseous coolant having high temperature and high pressure is obtained. The coolant having passed through the first compressor 52 or the second compressor 53 passes through the outdoor heat exchanger 54, where heat exchange is performed between the coolant and outdoor air blown by the outdoor fan 54*a* to obtain liquefied coolant having intermediate temperature and high pressure. The coolant having passed through the outdoor heat exchanger 54 passes through the capillary tube 64 and the auxiliary capillary tube 68 so that the coolant is decompressed to obtain coolant having low temperature and low pressure. The coolant having passed through the capillary tube 64 and the auxiliary capillary tube 68 passes through the second indoor heat exchanger 82, where heat exchange is performed between the coolant and indoor air blown by the second indoor fan 82*a* to obtain gaseous coolant having low temperature and low pressure, by which cool air is produced in the space where the second indoor unit 80 is installed. The coolant having passed through the second indoor heat exchanger 82 passes through the oil separator 56, by which oil is separated from the coolant, and the coolant containing no oil therein is introduced into the operating first compressor 52 or the operating second compressor 53.

As described above, the coolant is circulated through the first compressor 52 or the second compressor 53, the outdoor heat exchanger 54, the capillary tube 64 and the auxiliary capillary tube 68, the second indoor heat exchanger 82, and the oil separator 56, to cool the space where the second indoor unit 80 is installed.

When both of the first and second indoor units 70 and 80 are simultaneously operated by the user, all of the first and second compressors 52 and 53 are operated. The electronic expansion valve 62 is opened, and at the same time the shutoff valve 67 is also opened. The outdoor fan 54*a* and the first and second indoor fans 72*a* and 82*a* are operated.

The coolant passes through the first and second compressors 52 and 53 with the result that gaseous coolant having high temperature and high pressure is obtained. The coolants having passed through the first compressor 52 and the second compressor 53 are mixed together and the mixed coolant passes through the outdoor heat exchanger 54, where heat exchange is performed between the coolant and outdoor air blown by the outdoor fan 54*a* to obtain liquefied coolant having intermediate temperature and high pressure. The coolant having passed through the outdoor heat exchanger 54 is divided into two parts and the divided coolants pass through the electronic expansion valve 62 and the capillary tube 64, respectively, so that the coolants are decompressed to obtain coolants having low temperature and low pressure. The coolant having passed through the electronic expansion valve 62 passes through the first indoor heat exchanger 72, where heat exchange is performed between the coolant and indoor air blown by the first indoor fan 72*a* to obtain gaseous coolant having low temperature and low pressure, by which cool air is produced in the space where the first indoor unit 70 is installed. On the other hand, the coolant having passed through the capillary tube 64 passes through the second indoor heat exchanger 82, where heat exchange is performed between the coolant and indoor air blown by the second indoor fan 82*a* to obtain gaseous coolant having low temperature and low pressure, by which cool air is produced in the space where the second indoor unit 80 is installed. The coolants having passed through the first and second indoor heat exchangers 72 and 82 are mixed again together, and the mixed coolant pass through the oil separator 56, by which oil is separated from the coolant. The coolant containing no oil therein is divided again into two parts, and the divided coolants are introduced into the first and second compressors 52 and 53, respectively.

As described above, the coolant is circulated through the first and second compressors 52 and 53, the outdoor heat exchanger 54, the electronic expansion valve 62 and the capillary tube 64, the first and second indoor heat exchangers 72 and 82, and the oil separator 56, to cool the different spaces where the first and second indoor units 70 and 80 are individually installed.

At this time, the degree of opening of the electronic expansion valve 62 is controlled on the basis of the indoor load of the space where the first indoor unit 70 is installed and the outdoor load of the space where the outdoor unit 50 is installed.

Figure 8:
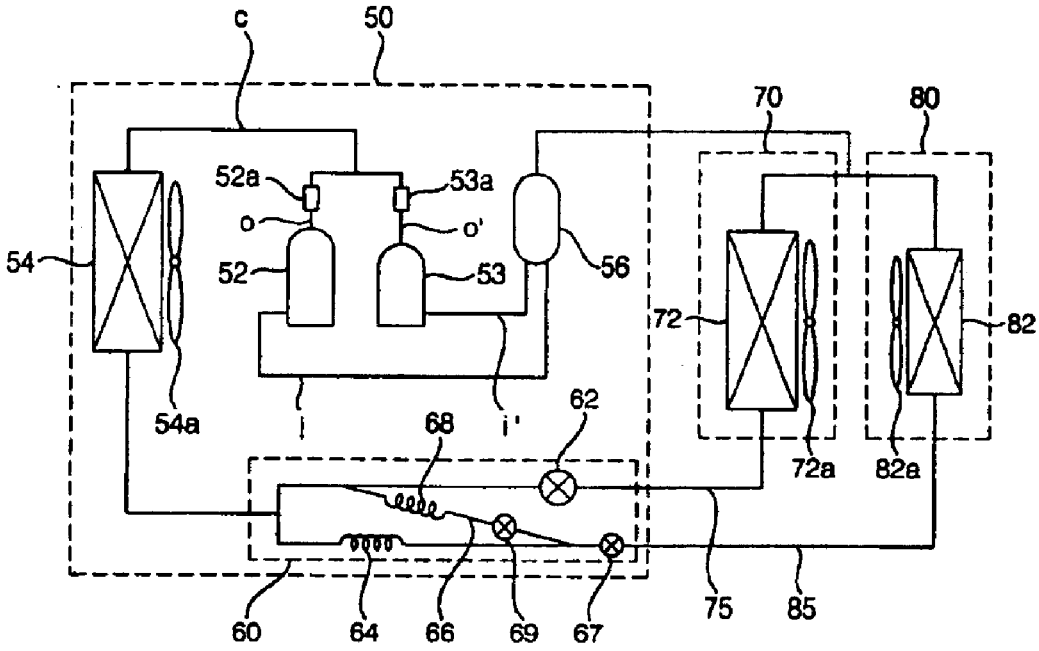
FIG. 8 is a schematic circuit diagram of an air conditioner according to a second preferred embodiment of the present invention.

FIG. 8 is a schematic circuit diagram of an air conditioner according to a second preferred embodiment of the present invention.

The air conditioner according to the second preferred embodiment of the present invention is identical to that according to the previously described first preferred embodiment of the present invention except that the expansion distributor 60 of this embodiment further comprises an auxiliary shutoff valve 69 disposed in the connection passage 66 at the rear end of the auxiliary capillary tube 68 for allowing or preventing the flow of the coolant.

Preferably, the shutoff valve 67 and the auxiliary shutoff valve 69 are solenoid valves that can be controlled by electrical signals from the microcomputer.

TABLE 2

| Operating Indoor Unit | Electronic Expansion Valve 62 | Shutoff Valve 67 | Auxiliary Shutoff Valve 69 |
|---|---|---|---|
| First Indoor Unit 70 | On | Off | Off |
| Second Indoor Unit 80 | Off | On | On |
| First and Second Indoor Units 70 and 80 | On | On | Off |

When only the first indoor unit 70 is operated, the electronic expansion valve 62 of the expansion distributor 60 is opened, and the shutoff valve 67 and the auxiliary shutoff valve 69 of the expansion distributor 60 are closed, as indicated in Table 2, so that the coolant passes through the electronic expansion valve 62 and then is introduced into the first indoor heat exchanger 72.

When only the second indoor unit 80 is operated, the electronic expansion valve 62 of the expansion distributor 60 is closed, and the shutoff valve 67 and the auxiliary shutoff valve 69 of the expansion distributor 60 are opened, as indicated in Table 2, so that the coolant passes through the capillary tube 64 and the auxiliary capillary tube 68 and then is introduced into the second indoor heat exchanger 82.

When both of the first and second indoor units 70 and 80 are simultaneously operated, the electronic expansion valve 62 and the shutoff valve 67 of the expansion distributor 60 are opened, and the auxiliary shutoff valve 69 of the expansion distributor 60 is closed, as indicated in Table 2, so that the coolant passes through the electronic expansion valve 62 and the capillary tube 64, and then is introduced into the first and second indoor heat exchangers 72 and 82, respectively.

The air conditioner according to the second preferred embodiment of the present invention is operated in the same manner as the air conditioner of the previously described first preferred embodiment. Accordingly, the detailed description of the operation of the air conditioner according to the second preferred embodiment of the present invention will not be given.

As described above, the air conditioner of the present invention further includes an additional auxiliary indoor unit connected to an air conditioner comprising an indoor unit and an outdoor unit connected to the indoor unit, the outdoor unit having two compressors mounted therein. Consequently, two indoor units can be individually installed in different spaces even though the air conditioner constitutes a single cooling cycle, whereby the two indoor units can be selectively or simultaneously operated on the basis of a life pattern of a user to effectively cool or warm the different spaces where the indoor units are individually installed.

As apparent from the above description, the present invention provides an improved air conditioner further including an additional auxiliary indoor unit connected to an air conditioner comprising an indoor unit and an outdoor unit connected to the indoor unit so that the indoor unit and the auxiliary indoor unit can be selectively or simultaneously operated according to the needs of a user, thereby conveniently cooling or warming the desired room(s) of a user's house. In addition, the space for installing the air conditioner is reduced since only one outdoor unit is installed, and the cost of manufacturing the air conditioner and the charge of installing the air conditioner are also reduced.

Furthermore, the air conditioner of the present invention further comprises an expansion distributor for controlling pressure reduction and flow rate of a coolant condensed in the outdoor unit to supply the coolant to each of the indoor units even though each of the two indoor units is connected to the single outdoor unit, thereby easily controlling the cooling/warming capacities, and thus effectively cooling or warming desired room(s) or space(s) individually or simultaneously.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner comprising:

an outdoor unit including a plurality of compressors for compressing a coolant, an outdoor heat exchanger connected to each of the compressors for condensing or evaporating the coolant as a condenser or an evaporator during cooling or heating a room of a house, and an expander connected to the outdoor heat exchanger for expanding the coolant; and an indoor unit including an indoor heat exchanger connected to the outdoor unit for evaporating or condensing the coolant as an evaporator or a condenser during cooling or heating the room of the house, the outdoor and indoor units together constituting a cooling cycle, wherein the outdoor unit comprises:

a plurality of discharging pipes connected to the compressors for discharging the coolants compressed in the compressors, respectively;

a connection pipe for gathering the coolants leaving the discharging pipes to guide the gathered coolants via the condenser, the expander, and the evaporator;

a plurality of introducing pipes each branched off the end of the connection pipe for introducing the coolants into the compressors, respectively; and an oil separator disposed between the connection pipe and the introducing pipes for separating oil from the coolants discharged from the compressors, and wherein the air conditioner further comprises at least one auxiliary indoor unit including an indoor heat exchanger detachably attached to the outdoor unit.

2. The air conditioner as set forth in claim 1, wherein the auxiliary indoor unit is installed in some place other than the indoor unit.

3. The air conditioner as set forth in claim 1, wherein the outdoor unit further comprises check valves disposed in the discharging pipes for preventing the coolant from flowing backward toward the compressors, respectively.

4. The air conditioner as set forth in claim 1, wherein the outdoor unit further comprises accumulators disposed between the oil separator and the compressors for separating the liquefied coolant from the coolant flowing into the compressors.

5. The air conditioner as set forth in claim 1, wherein the oil separator comprises: a hermetically sealed casing 56*a* connected to each of the introducing pipes of the compressors; a screen mesh mounted in the inner upper part of the casing for filtering foreign matters from the coolant and the oil; oil separating pipes disposed below the screen mesh, each of the oil separating pipes having one end placed above the height of the liquefied coolant so that only gaseous coolant is introduced into the casing and the other end connected to one of the introducing pipes for introducing the coolant into one of the first and second compressors; and oil collection holes formed at the lower parts of the oil separating pipes so that the oil gathered on the bottom of the casing is introduced into the oil separating pipes by means of the speed of a flow of the gaseous coolant flowing through the oil separating pipes, respectively.

6. The air conditioner as set forth in claim 5, wherein the oil separator further comprises a disc-shaped screen interposed between the screen mesh and the one end of each of the oil separating pipes for preventing the liquefied coolant from flowing into the one end of each of the oil separating pipes; and a fixing bracket for fixing the oil separating pipes to the inner wall of the casing to prevent the oil separating pipes from shaking in the casing.

7. The air conditioner as set forth in claim 1, wherein the number of the compressors is two.

8. The air conditioner as set forth in claim 7, wherein the two compressors have coolant compression capacities different from each other.

9. An air conditioner comprising:

an outdoor unit including a plurality of compressors for compressing a coolant, an outdoor heat exchanger connected to each of the compressors for condensing or evaporating the coolant as a condenser or an evaporator during cooling or heating a room of a house, and an expander connected to the outdoor heat exchanger for expanding the coolant; and an indoor unit including an indoor heat exchanger connected to the outdoor unit for evaporating or condensing the coolant as an evaporator or a condenser during cooling or heating the room of the house, the outdoor and indoor units together constituting a cooling cycle, wherein the outdoor unit comprises:

a plurality of discharging pipes connected to the compressors for discharging the coolants compressed in the compressors, respectively;

a connection pipe for gathering the coolants leaving the discharging pipes to guide the gathered coolants via the condenser, the expander, and the evaporator;

a plurality of introducing pipes each branched off the end of the connection pipe for introducing the coolants into the compressors, respectively; and an oil separator disposed between the connection pipe and the introducing pipes for separating oil from the coolants discharged from the compressors, and wherein the air conditioner further comprises:

at least one auxiliary indoor unit including an indoor heat exchanger detachably attached to the outdoor unit; and an expansion distributor disposed between the outdoor unit and the indoor unit and between the outdoor unit and the auxiliary indoor unit for expanding the coolants to distribute the expanded coolants into each of the indoor heat exchangers of the indoor unit and the auxiliary indoor unit.

10. The air conditioner as set forth in claim 9, wherein the indoor heat exchangers comprise a first indoor heat exchanger mounted in the indoor unit and a second indoor heat exchanger mounted in the auxiliary indoor unit.

11. The air conditioner as set forth in claim 10, wherein the first indoor heat exchanger has a heat exchange capacity larger than the second indoor heat exchanger.

12. The air conditioner as set forth in claim 9, wherein:

the compressors comprise a first compressor and a second compressor; and one of the first and second compressors is operated depending upon the load thereof when one of the indoor and auxiliary indoor units is operated, and both of the first and second compressors are operated when both of the indoor and auxiliary indoor units are simultaneously operated.

13. The air conditioner as set forth in claim 9, wherein:

the indoor heat exchangers comprise a first indoor heat exchanger mounted in the indoor unit and a second indoor heat exchanger mounted in the auxiliary indoor unit, the second indoor heat exchanger having a heat exchange capacity smaller than the first indoor heat exchanger; and the expansion distributor comprises: an electronic expansion valve disposed between the outdoor heat exchanger and the first indoor heat exchanger; a capillary tube disposed between the outdoor heat exchanger and the second indoor heat exchanger; and a distributing unit disposed between the electronic expansion valve and the capillary tube for distributing the coolant to the first and second indoor heat exchangers.

14. The air conditioner as set forth in claim 13, wherein the distributing unit comprises: a connection passage connected between the front end of the electronic expansion valve and the rear end of the capillary tube so that the coolant flows between the electronic expansion valve and the capillary tube; and a shutoff valve mounted at the rear end of the capillary tube for allowing or preventing the flow of the coolant having passed through the capillary tube and the connection passage.

15. The air conditioner as set forth in claim 14, wherein the distributing unit further comprises an auxiliary capillary tube disposed in the connection passage for decompressing the coolant.

16. The air conditioner as set forth in claim 15, wherein the electronic expansion valve of the expansion distributor is opened, and the shutoff valve of the expansion distributor is closed so that the coolant passes through the electronic expansion valve and then is introduced into the first indoor heat exchanger, when only the first indoor unit is operated.

17. The air conditioner as set forth in claim 15, wherein the electronic expansion valve of the expansion distributor is closed, and the shutoff valve of the expansion distributor is opened so that the coolant passes through the capillary tube and the auxiliary capillary tube and then is introduced into the second indoor heat exchanger, when only the second indoor unit is operated.

18. The air conditioner as set forth in claim 15, wherein the electronic expansion valve and the shutoff valve of the expansion distributor are simultaneously opened so that the coolant passes through the electronic expansion valve and then is introduced into the first indoor heat exchanger and so that the coolant passes through the capillary tube and then is introduced into the second indoor heat exchanger, when both of the first and second indoor units are simultaneously operated.

19. The air conditioner as set forth in claim 15, wherein the distributing unit further comprises an auxiliary shutoff valve disposed in the connection passage at the rear end of the auxiliary capillary tube for allowing or preventing the flow of the coolant.

20. The air conditioner as set forth in claim 19, wherein the electronic expansion valve of the expansion distributor is opened, and the shutoff valve and the auxiliary shutoff valve of the expansion distributor are closed so that the coolant passes through the electronic expansion valve and then is introduced into the first indoor heat exchanger, when only the first indoor unit is operated.

21. The air conditioner as set forth in claim 19, wherein the electronic expansion valve of the expansion distributor is closed, and the shutoff valve and the auxiliary shutoff valve of the expansion distributor are opened so that the coolant passes through the capillary tube and the auxiliary capillary tube and then is introduced into the second indoor heat exchanger, when only the second indoor unit is operated.

22. The air conditioner as set forth in claim 19, wherein the electronic expansion valve and the shutoff valve of the expansion distributor are opened, and the auxiliary shutoff valve of the expansion distributor is closed so that the coolant passes through the electronic expansion valve and then is introduced into the first indoor heat exchanger and so that the coolant passes through the capillary tube and then is introduced into the second indoor heat exchanger, when both of the first and second indoor units are simultaneously operated.

* * * * *